US006791517B2

(12) United States Patent
Choi

(10) Patent No.: US 6,791,517 B2
(45) Date of Patent: Sep. 14, 2004

(54) PLASMA DISPLAY PANEL AND DRIVING METHOD THEREOF

(75) Inventor: Sung Chun Choi, Kyonggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/985,919

(22) Filed: Nov. 6, 2001

(65) Prior Publication Data

US 2002/0053883 A1 May 9, 2002

(30) Foreign Application Priority Data

Nov. 7, 2000 (KR) ..... 2000-65959

(51) Int. Cl.[7] ..... G09G 3/30; G09G 3/10

(52) U.S. Cl. ..... 345/76; 345/78; 345/77; 315/169.3

(58) Field of Search ..... 345/76, 77, 78, 345/66, 63, 60, 55, 75, 74; 315/169.3, 169.4, 169.1

(56) References Cited

U.S. PATENT DOCUMENTS

| | | | | |
|---|---|---|---|---|
| 6,255,779 | B1 * | 7/2001 | Ha et al. | 313/582 |
| 6,266,033 | B1 * | 7/2001 | Kim | 345/66 |
| 6,597,120 | B1 * | 7/2003 | Schemerhorn et al. | 315/169.3 |
| 2001/0011974 | A1 * | 8/2001 | Kang et al. | 345/60 |
| 2001/0026129 | A1 * | 10/2001 | Ahn et al. | 313/586 |
| 2001/0047566 | A1 * | 4/2002 | Kim et al. | 315/169.3 |

* cited by examiner

*Primary Examiner*—Tuyet T. Vo
(74) *Attorney, Agent, or Firm*—Fleshner & Kim LLP

(57) ABSTRACT

A PDP and a driving method thereof are disclosed in which luminous efficiency can be improved. The PDP includes a scan/sustain electrode formed at a peripheral portion of a discharge cell, a common sustain electrode formed to oppose the scan/sustain electrode at the peripheral portion of the discharge cell, a first trigger electrode formed to be adjacent to the scan/sustain electrode, and a second trigger electrode formed to be adjacent to the common sustain electrode.

8 Claims, 7 Drawing Sheets

PLASMA DISPLAY PANEL AND DRIVING METHOD THEREOF

This application claims the benefit of the Korean Application No. P2000-65959 filed on Nov. 7, 2000, which is herein incorporated by reference.

BACKGROUND OF THE INVENTION

1. Field of the Invention

The present invention relates to a plasma display panel (PDP) and a driving method thereof, and more particularly, to a PDP and a driving method thereof that can improve luminous efficiency.

2. Discussion of the Stated Art

A PDP is a display device using visible rays generated from a phosphor when vacuum ultraviolet rays gene-rated by gas discharge excite the phosphor. The PDP is thinner and lighter in weight than a cathode ray tube (CRT) that has been mainly used as a display device. The PDP also enables a large sized screen with high definition.

Such a PDP includes a plurality of discharge cells, each cell having one pixel on a screen.

FIG. 1 is a perspective view illustrating a discharge cell of a related art three-electrode alternating current area discharge type PDP.

Referring to FIG. 1, the discharge cell of the related art three-electrode alternating current area discharge type PDP includes a scan/sustain electrode 12Y, a common sustain electrode 12Z, and an address electrode 20X. The scan/sustain electrode 12Y and the common sustain electrode 12Z are formed on an upper substrate 10, and the address electrode 20X is formed on a lower substrate 18.

On the upper substrate 10 on which the scan/sustain electrode 12Y and the common sustain electrode 12Z are formed in parallel, an upper dielectric layer 14 and a passivation film 16 are layered. Wall charges generated by a plasma discharge are accumulated in the upper dielectric layer 14. The passivation film 16 prevents the upper dielectric layer 14 from being damaged due to sputtering generated by the plasma discharge and increases secondary electron emission. MgO is generally used as the passivation film 16.

A lower dielectric layer 22 and a sidewall 24 are formed on the lower substrate 18 on which the address electrode 20X is formed. A phosphor layer 26 is deposited on surfaces of the lower dielectric layer 22 and the sidewall 24.

The address electrode 20X is formed to cross the scan/sustain electrode 12Y and the common sustain electrode 12Z. The sidewall 24 is formed in parallel with the address electrode 20X, so that ultraviolet rays and visible rays generated by a discharge are prevented from leaking out to an adjacent discharge cell. The phosphor layer 26 is excited by the ultraviolet rays generated by the plasma discharge and generates one of red, green, or blue visible rays.

Also, an inert gas for a gas discharge is injected into a discharge space between the upper substrate 10 or the lower substrate 18 and the sidewall 24.

The aforementioned alternating current area discharge type PDP divides one frame into a plurality of sub-fields having different discharge number of times to display gray level of a picture image. Each sub-field includes a reset period for uniformly generating a discharge, an address period for selecting a discharge cell, and a sustain period for displaying gray level in accordance with discharge number of times. For example, if a picture image is displayed in 256 gray levels, a frame period (16.67 ms) corresponding to 1/60 sec. is divided into eight sub-fields. Each of the eight sub-fields is divided into a reset period, an address period, and a sustain period. The reset period has the same value in each sub-field. Likewise, the address period has the same value in each sub-field. However, the sustain period is increased at a rate of $2^n$ (n=0, 1, 2, 3, 4, 5, 6, 7) in each sub-field. Since the sustain period is varied in each sub-field, gray level of the picture image can be displayed.

A reset pulse is supplied to the scan/sustain electrode 12Y during the reset period, so that a reset discharge occurs. During the address period, a scan pulse is supplied to the scan/sustain electrode 12Y and a data pulse is supplied to the address electrode 20X so that an address discharge occurs between the electrodes 12Y and 20X. Wall charges are generated in the upper and lower dielectric layers 14 and 22 during the address discharge. During the sustain period, an alternating current signal is alternately supplied to the scan/sustain electrode 12Y and the common sustain electrode 12Z so that a sustain discharge occurs between the electrodes 12Y and 12Z.

However, in the related art alternating current area discharge type PDP, a sustain discharge space is concentrated on the center of the upper substrate 10, thereby reducing applicability of the discharge space. That is, as shown in FIG. 2, since the sustain discharge occurs between the scan/sustain electrode 12Y and the common sustain electrode 12Z formed on the upper substrate 10 at a narrow distance, a discharge area is reduced, thereby reducing luminous efficiency. At this time, if the scan/sustain electrode 12Y and the common sustain electrode 12Z are formed at a widen distance to increase the discharge area, a high driving voltage should be applied to the scan/sustain electrode 12Y and the common sustain electrode 12Z. That is, power consumption is increased for the sustain discharge, thereby reducing driving efficiency of the PDP.

To solve such a problem, a five-electrode alternating current area discharge type PDP as shown in FIG. 3 has been proposed.

FIG. 3 is a perspective view illustrating a discharge cell of another related art five-electrode alternating current area discharge type PDP.

Referring to FIG. 3, the related art five-electrode alternating current area discharge type PDP includes first and second trigger electrodes 34Y and 34Z formed at the center of a discharge cell on an upper substrate 30, a scan/sustain electrode 32Y and a common sustain electrode 32Z formed at a peripheral portion of the discharge cell on the upper substrate 30, and an address electrode 42X formed at the center of the lower substrate 40 to be orthogonal to the trigger electrodes 34Y and 34Z, the scan/sustain electrodes 32Y, and the common sustain electrode 32Z. On the upper substrate 30 on which the scan/sustain electrode 32Y, the first trigger electrode 34Y, the second trigger electrode 34Z, and the common sustain electrode 32Z are formed in parallel, an upper dielectric layer 36 and a passivation film 38 are layered. On the lower substrate 40 on which the address electrode 42X is formed, a lower dielectric layer 44 and a sidewall 46 are formed. A phosphor layer 48 is deposited on surfaces of the lower dielectric layer 44 and the sidewall 46.

An alternating current pulse is supplied to the trigger electrodes 34Y and 34Z formed at the center of the discharge cell at a narrow distance during the sustain period. The trigger electrodes 34Y and 34Z are used to start a sustain discharge. The alternating current pulse is also supplied to the scan/sustain electrode 32Y and the common sustain electrode 32Z formed at a widen distance at the peripheral portion of the discharge cell during the sustain period. The scan/sustain electrode 32Y and the common sustain electrode 32Z are used to start a plasma discharge between the trigger electrodes 34Y and 34Z and to maintain the plasma discharge. To drive the five-electrode alternating current area discharge type PDP, a waveform shown in FIG. 4 is applied.

Referring to FIG. 4, in the related art five-electrode alternating current area discharge type PDP, one frame is divided into various sub-field having different discharge number of times to display gray level of a picture image. Each sub-field includes a reset period for uniformly generating a discharge, an address period for selecting a discharge cell, and a sustain period for displaying gray level in accordance with discharge number of times.

During the reset period, a reset pulse is supplied to the second trigger electrode Tz so that a reset discharge for initiating the discharge cell occurs. At this time, a direct current voltage is supplied to the address electrode X to prevent an error discharge from occurring.

During the address period, scan pulses C are sequentially supplied to the first trigger electrode Ty and data pulses Va synchronized with the scan pulses C are supplied to the address electrode X. At this time, an address discharge occurs in the discharge cell to which the data pulses Va are supplied.

During the sustain period, sustain pulses are alternately applied between the first trigger electrode Ty and the scan/sustain electrode Sy and between the second trigger electrode Tz and the common sustain electrode Sz. At this time, a voltage Vt applied to the trigger electrodes Ty and Tz has a lower level than a voltage Vs applied to the scan/sustain electrode Sy and the common sustain electrode Sz. During the sustain period, a direct current voltage is supplied to the address electrode X to prevent an error discharge from occurring.

A sustain discharge step will be described in more detail with reference to FIG. 5.

First, if the sustain pulse is applied to the first trigger electrode Ty, the scan/sustain electrode Sy, the second trigger electrode Tz, and the common sustain electrode Sz, a trigger discharge occurs between the first trigger electrode Ty and the second trigger electrode Tz. Then, a transition discharge occurs between the second trigger electrode Tz and the common sustain electrode Sz or between the first trigger electrode Ty and the scan/sustain electrode Sy. As a result, the trigger discharge generated between the first trigger electrode Ty and the second trigger electrode Tz is transited to the sustain discharge between the scan/sustain electrode Sy and the common sustain electrode Sz. In other words, the sustain discharge occurs between the scan/sustain electrode Sy and the common sustain electrode Sz after the transition discharge occurs. At this time, even if the distance between the scan/sustain electrode Sy and the common sustain electrode Sz is great, a discharge can occur by means of a sustain pulse having a relatively low voltage level due to priming charged particles generated by the transition discharge. Thus, the sustain discharge having a long discharge path can occur while reducing increase of a sustain voltage.

However, a transition discharge path in the five-electrode alternating current area discharge type POP is almost half of a sustain discharge path. That is, to generate the transition discharge corresponding to half of the sustain discharge path, a high voltage should be applied to the trigger electrodes Ty and Tz. A strong transition discharge occurs due to the high voltage applied to the trigger electrodes Ty and Tz. Wall charges are generated by the transition discharge and accumulated in a surface of the scan/sustain electrode 12Y or the common sustain electrode 12Z. The wall charges accumulated in the scan/sustain electrode 12Y or the common sustain electrode 12Z cause the sustain discharge contributed to luminance to be weakened, thereby reducing luminous efficiency of the PDP.

SUMMARY OF THE INVENTION

Accordingly, the present invention is directed to a PDP and a driving method thereof that substantially obviates one or more problems due to limitations and disadvantages of the related art.

An object of the present invention is to provide a PDP and a driving method thereof in which luminous efficiency can be improved.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a PDP according to the present invention includes: a scan/sustain electrode formed at a peripheral portion of a discharge cell; a common sustain electrode formed to oppose the scan/sustain electrode at the peripheral portion of the discharge cell; a first trigger electrode formed to be adjacent to the scan/sustain electrode; and a second trigger electrode formed to be adjacent to the common sustain electrode.

In another aspect, a PDP according to the present invention includes: a scan/sustain electrode formed at a peripheral portion of a discharge cell; a common sustain electrode formed to oppose the scan/sustain electrode at the peripheral portion of the discharge cell; a first trigger electrode formed to be adjacent to the scan/sustain electrode; and a second trigger electrode formed to be adjacent to the common sustain electrode, the first and second trigger electrodes being formed between the scan/sustain electrode and the common sustain electrode.

In another aspect, a POP according to the present intention includes: a first trigger electrode formed at a peripheral portion of a discharge cell; a second trigger electrode formed to oppose the first trigger electrode at the peripheral portion of the discharge cell; a scan/sustain electrode formed to be adjacent to the first trigger electrode; and a common sustain electrode formed to be adjacent to the second trigger electrode, the scan/sustain electrode and the common sustain electrode being formed between the first and second trigger electrodes.

In another aspect, a method for driving a PDP according to the present invention includes the steps of: alternately applying a first sustain pulse having a predetermined voltage to a scan/sustain electrode and a common sustain electrode during a sustain period; supplying a second sustain pulse to a first trigger electrode whenever the first sustain pulse is supplied to the scan/sustain electrode and the common sustain electrode; and supplying a third sustain pulse to a second trigger electrode whenever the first sustain pulse is supplied to the scan/sustain electrode and the common sustain electrode.

The second and third sustain pulses have a lower voltage value than the first sustain pulse.

The method for driving a PDP further includes the steps of supplying the second sustain pulse having a lower voltage value than the first sustain pulse to the first trigger electrode when the first sustain pulse is supplied to the scan/sustain electrode, and supplying the third sustain pulse having a lower voltage value than the second sustain pulse to the second trigger electrode when the first sustain pulse is supplied to the scan/sustain electrode.

The method, for driving a PDP further includes the steps of supplying the third sustain pulse having a lower voltage value than the first sustain pulse to the second trigger electrode when the first sustain pulse is supplied to the common sustain electrode, and supplying the second sustain pulse having a lower voltage value than the third sustain pulse to the first trigger electrode when the first sustain pulse is supplied to the common sustain electrode.

If the second and third sustain pulses have the same voltage value, the second sustain pulse having a lower voltage value than the first sustain pulse is synchronized with the first sustain pulse supplied to the scan/sustain electrode and the common sustain electrode, and is supplied to the first trigger electrode. The third sustain pulse having a lower voltage value than the first sustain pulse is supplied to the second trigger electrode.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
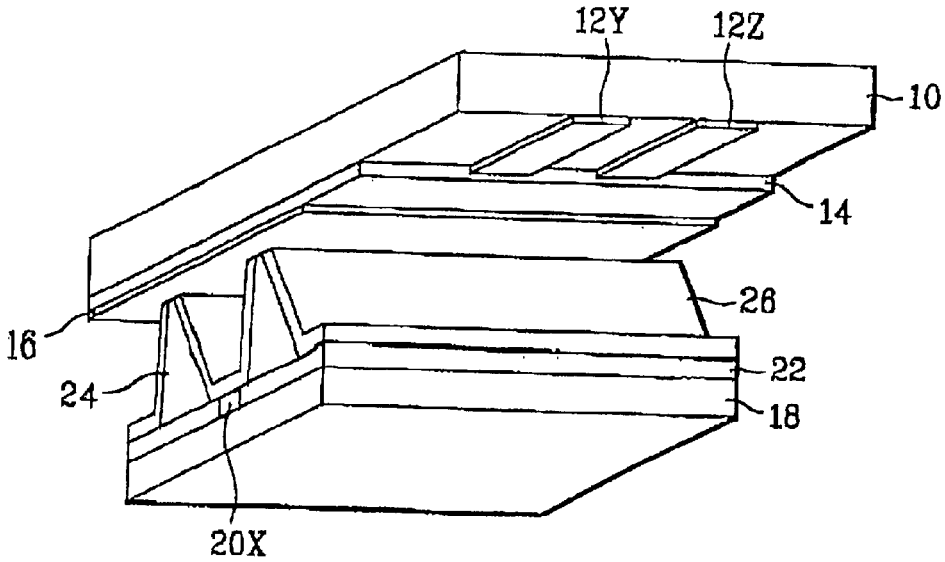
FIG. 1 Background Art
FIG. 1 is a perspective view illustrating a discharge cell of a related art three-electrode PDP.
Figure 2:
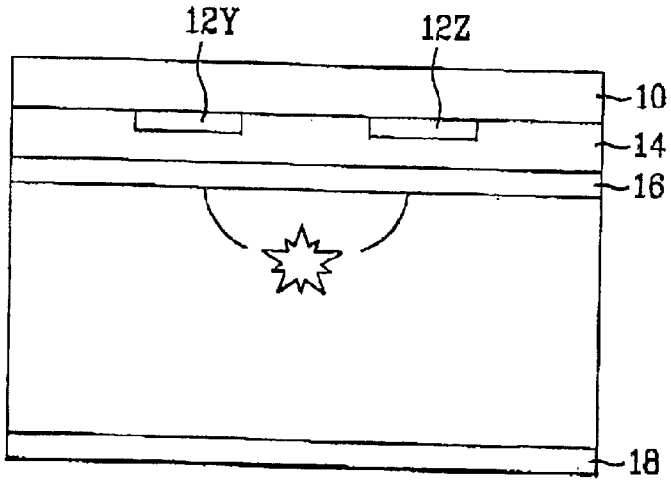
FIG. 2 Background Art
FIG. 2 is a sectional view illustrating a sustain discharge of the PDP shown in FIG. 1.
Figure 3:
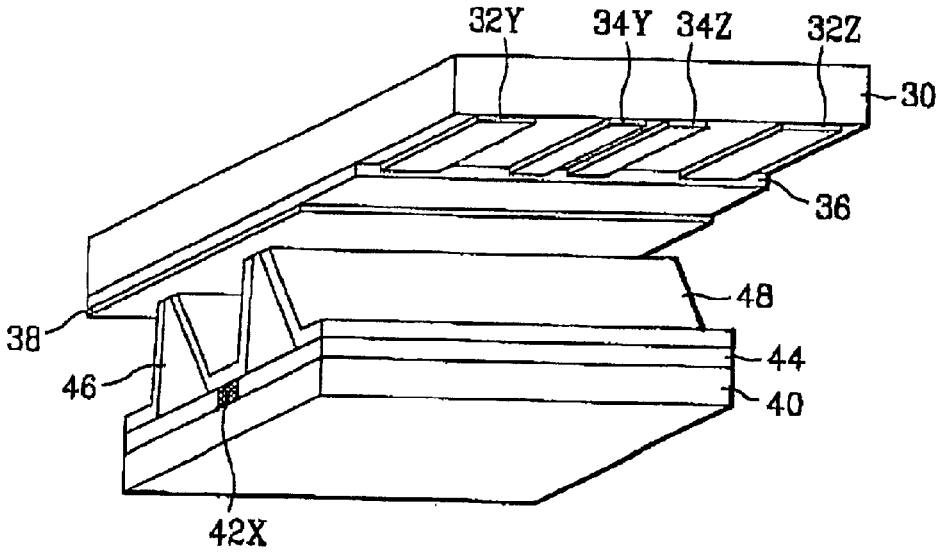
FIG. 3 Background Art
FIG. 3 is a perspective view illustrating a discharge cell of a related art five-electrode PDP.
Figure 4:
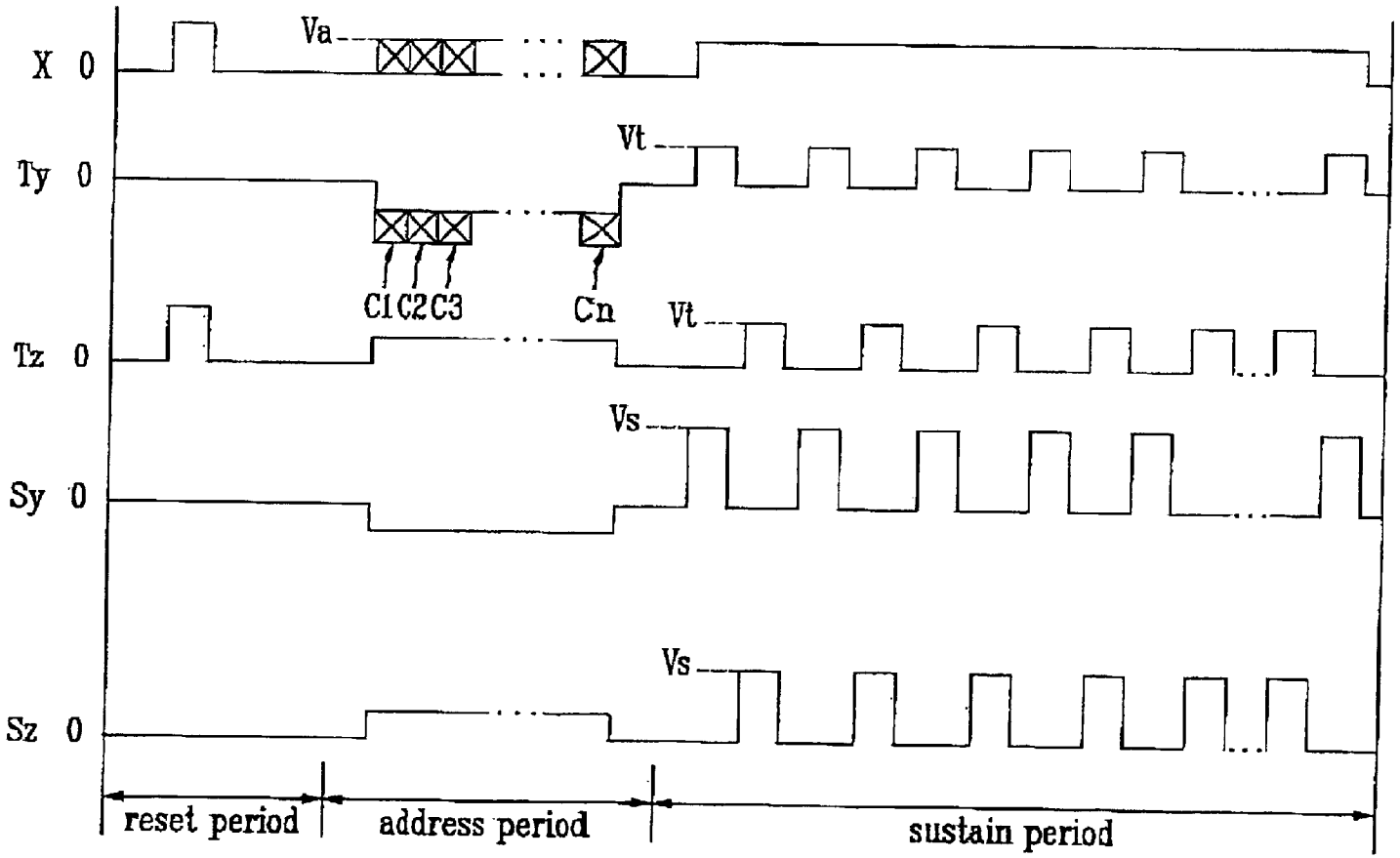
FIG. 4 Background Art
FIG. 4 illustrates a driving waveform applied to the PDP shown in FIG. 3.
Figure 5:
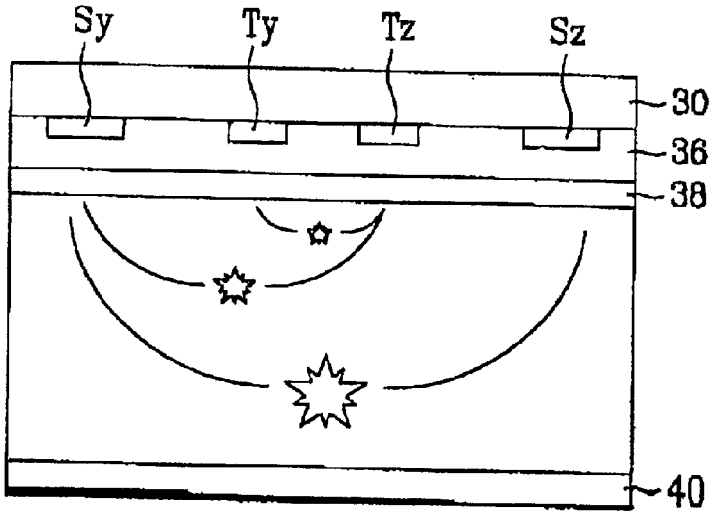
FIG. 5 Background Art
FIG. 5 is a sectional view illustrating a sustain discharge of the PDP shown in FIG. 3.
Figure 6:
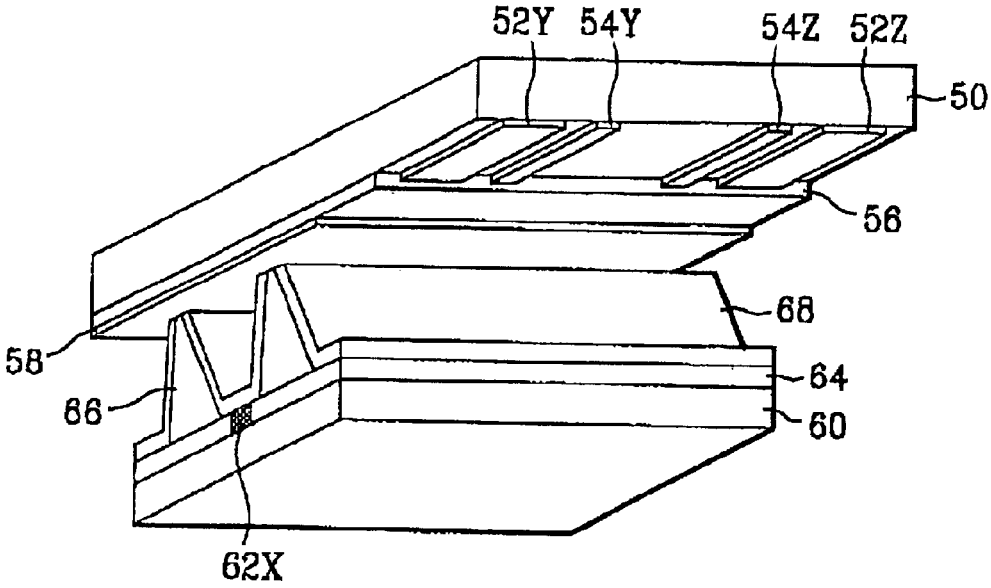
FIG. 6 is a perspective view illustrating a discharge cell of a PDP according to the first embodiment of the present invention.

FIG. 6 is a perspective view illustrating a structure of a discharge cell of a PDP according to the first embodiment of the present invention.

Referring to FIG. 6, the PDP according to the first embodiment of the present invention includes a scan/sustain electrode 52Y and a common sustain electrode 52Z formed at a peripheral portion of a discharge cell on an upper substrate 50, first and second trigger electrodes 54Y and 54Z formed to be adjacent to the scan/sustain electrode 52Y and the common sustain electrode 52Z, and an address electrode 62X formed at the center of a lower substrate 6C to be orthogonal to the first and second trigger electrodes 54Y and 54Z, the scan/sustain electrodes 52Y, and the common sustain electrodes 52Z. On the upper substrate SO on which the scan/sustain electrode 52Y, the first trigger electrode 54Y, the second trigger electrode 54Z, and the common sustain electrode 52Z are forced in parallel, an upper dielectric layer 56 and a passivation film 58 are layered. On the lower substrate 60 on which the address electrode 62X is formed, a lower dielectric layer 64 and a sidewall 66 are formed. A phosphor layer 68 is deposited on surfaces of the lower dielectric layer 64 and the sidewall 66.

Unlike the related art PDP, in the first embodiment of the present invention, the scan/sustain electrode 52Y and the first trigger electrode 54Y are disposed to be adjacent to each other. Also, the common sustain electrode 52Z and the second trigger electrode 54Z are disposed to be adjacent to each other that is, in the related art PDP, the first and second triggers 34Y and 34Z are formed at the center of the upper substrate 30. While the first and second trigger electrodes 54Y and 54Z of the present invention are disposed to be adjacent to the scan/sustain electrode 52Y and the common sustain electrode 52Z. For example, the scan/sustain electrode 52Y and the common sustain electrode 52Z are formed at a width of 180 $\mu$m while the first and second trigger electrodes 54Y and 52Z are formed at a width of 80 $\mu$m. The scan/sustain electrode 52Y and the first trigger electrode 54Y are formed at a distance of 80 $\mu$m. The common sustain electrode 52Z and the second trigger electrode 54Z are also formed at a distance of 80 $\mu$m.

An alternating current pulse is supplied to the trigger electrodes 54Y and 54Z adjacent to the scan/sustain electrode 52Y and the common sustain electrode 52Z during a sustain period. Thus, a trigger discharge occurs between the first trigger electrode and the scan/sustain electrode 52Y and between the second trigger electrode and the common sustain electrode 52Z. The alternating current pulse is also supplied to the scan/sustain electrode 52Y and the common sustain electrode 52Z formed at the peripheral portion of the discharge cell during the sustain period. Thus, a trigger discharge occurs between the first trigger electrode 54Y and the scan/sustain electrode 52Y and between the second trigger electrode 54Z and the common sustain electrode 52Z. Also, the scan/sustain electrode 52Y and the common sustain electrode 52Z are used to maintain a plasma discharge after starting the trigger discharge.

In the PDP according to the first embodiment of the present invention, one frame is divided into various sub-fields having different discharge number of times to display gray level of a picture image. Each sub-field includes a reset period for uniformly generating a discharge, an address period for selecting a discharge cell, and a sustain period for displaying gray level in accordance with discharge number of times.

During the reset period, a reset pulse is supplied to the second trigger electrode 54Z so that a reset discharge for initiating the discharge cell occurs. At this time, a direct current voltage is supplied to the address electrode 62X to prevent an error discharge from occurring.

During the address period, scan pulses are sequentially supplied to the first trigger electrode 54Y and data pulses synchronized with the scan pulses are supplied to the address electrode 62X. At this time, an address discharge occurs in the discharge cell to which the data pulses are supplied.

During the sustain period, sustain pulses are applied to the first trigger electrode 54Y, the second trigger electrode 54Z, the scan/sustain electrode 52Y, and the common sustain electrode 52Z.

Figure 7:
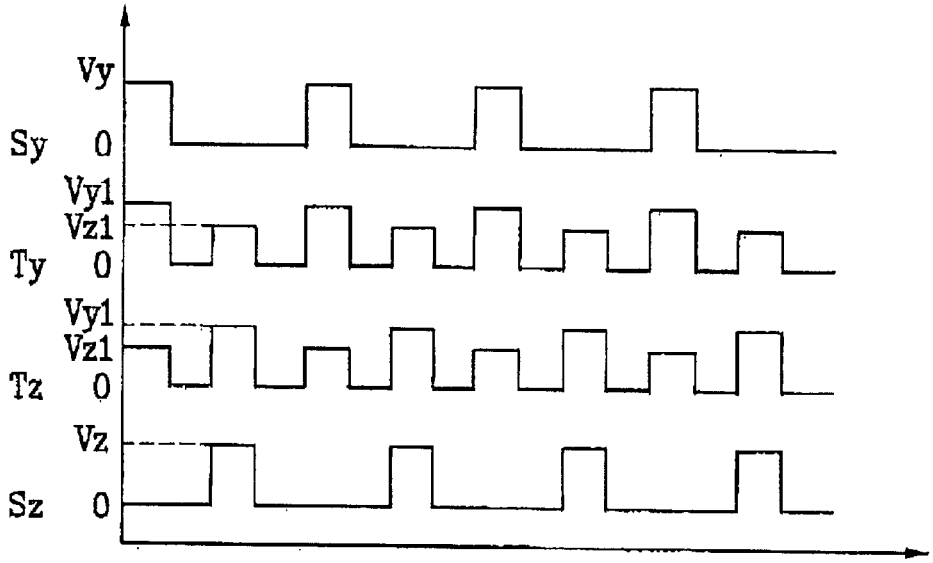
FIG. 7 illustrates a driving waveform applied to the PDP shown in FIG. 6 during a sustain period.

FIG. 7 is a waveform of the sustain pulses applied to the respective electrodes 52Y, 52Z, 54Y, and 54Z during the sustain period.

Referring to FIG. 7 the sustain pulses having different voltages are supplied to the scan/sustain electrode Sy, the common sustain electrode Sz, the first trigger electrode Ty, and the second trigger electrode Tz.

At this time, it is assumed that a trigger discharge occurs when a voltage difference of 230V or greater should be generated between adjacent electrodes, i.e., between the scan/sustain electrode Sy and the first trigger electrode Ty and between the common sustain electrode Sz and the second trigger electrode Tz. In this case, the sustain period will be described below.

First, the sustain pulse having a predetermined voltage value Vy (ex, 350V) is applied to the scan/sustain electrode Sv. At this time, the sustain pulse having a lower voltage value Vyl (ex, 300V) than the sustain pulse applied to the scan/sustain electrode Sy is supplied to the first trigger electrode Ty. The sustain pulse having a lower voltage value Vzl (ex, 200V) than the sustain pulse applied to the first trigger electrode Ty is supplied to the second trigger electrode Tz. The voltage value Vy of the sustain pulse applied to the scan/sustain electrode Sy is higher by about 50V than the voltage value Vyl of the sustain pulse applied to the first trigger electrode Ty. Meanwhile, the sustain pulse having a voltage value of 0V is applied to the common sustain electrode Sz. That is, a voltage difference of 50V occurs between the scan/sustain electrode Sy and the first trigger electrode Ty while a voltage difference of 200V occurs between the common sustain electrode Sz and the second trigger electrode Tz.

Figure 9:
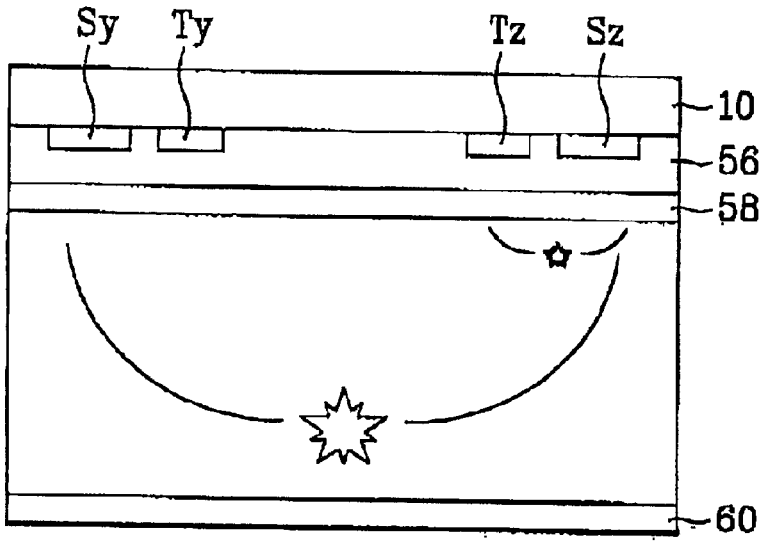
FIGS. 9 and 10 are sectional views illustrating a sustain discharge of the PDP shown in FIG. 6.

If the sustain pulse is applied as above, a voltage difference of wall charges formed in discharge cells selected during the address period is added to the voltage difference between the common sustain electrode Sz and the second trigger electrode Tz, thereby resulting in that the trigger discharge occurs as shown in FIG. 9. After the trigger discharge occurs between the common sustain electrode Sz and the second trigger electrode Tz, a sustain discharge occurs between the scan/sustain electrode Sy and the common sustain electrode Sz.

In the related art five-electrode PDP, the trigger discharge and the transition discharge occur before the sustain discharge occurs. However, in the PDP according to the first embodiment of the present invention, the trigger discharge only occurs before the sustain discharge occurs. In other words, since the transition discharge corresponding to half of the sustain discharge path does not occur, discharge efficiency can be improved.

Afterwards, the sustain pulse having a predetermined voltage value Vz (ex, 350V) is applied to the common sustain electrode Sz. That is, the voltage Vz of the sustain pulse applied to the common sustain electrode Sz is equal to the voltage Vy of the sustain pulse applied to the scan/sustain electrode Sy. After the sustain pulse having a predetermined voltage value Vz is applied to the common sustain electrode Sz, the sustain pulse having a lower voltage value Vyl (ex, 300V) than the sustain pulse applied to the common sustain electrode Sz is supplied to the second trigger electrode Tz. Meanwhile, the sustain pulse having a lower voltage value Vzl (ex, 200V) than the sustain pulse applied to the second trigger electrode Tz is supplied to the first trigger electrode Ty, and the sustain pulse having a voltage value of 0V is applied to the scan/sustain electrode Sy.

Figure 10:
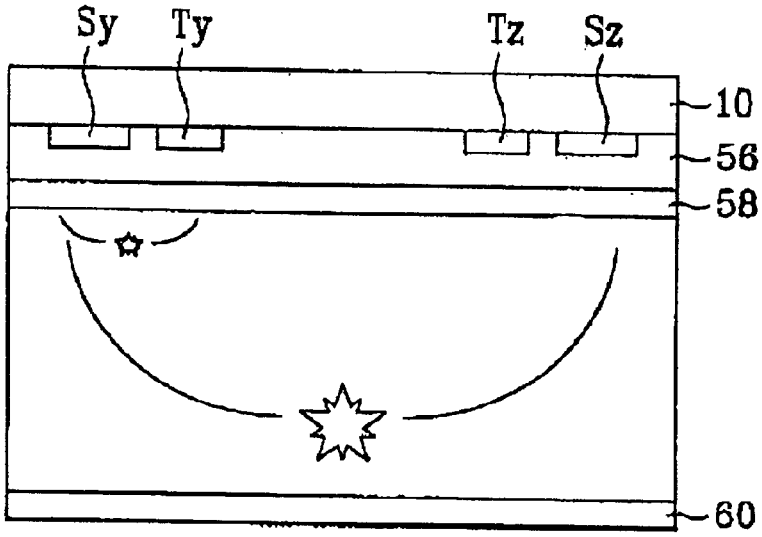

If the sustain pulse is applied, the wall voltage difference generated by the voltage difference 50V of the sustain pulse previously applied to the scan/sustain electrode Sy and the first trigger electrode Ty are added to the voltage difference 200V of the sustain pulse currently applied to the scan/sustain electrode Sy and the first trigger electrode Ty, thereby resulting in that the trigger discharge occurs as shown in FIG. 10. After the trigger discharge occurs between the scan/sustain electrode Sy and the first trigger electrode Ty, the sustain discharge occurs between the scan/sustain electrode Sy and the common sustain electrode Sz. In the sustain period of the present invention, the sustain pulse is alternately applied to the respective electrodes Sy, Sz, Ty and Tz. Meanwhile, since wall charges are not formed in discharge cells which are not selected in the address period, conditions for discharge are not generated. In other words, since no voltage difference of 230V occurs in the discharge cells which are not selected in the address period, the trigger discharge and the sustain discharge are not generated.

Figure 8:
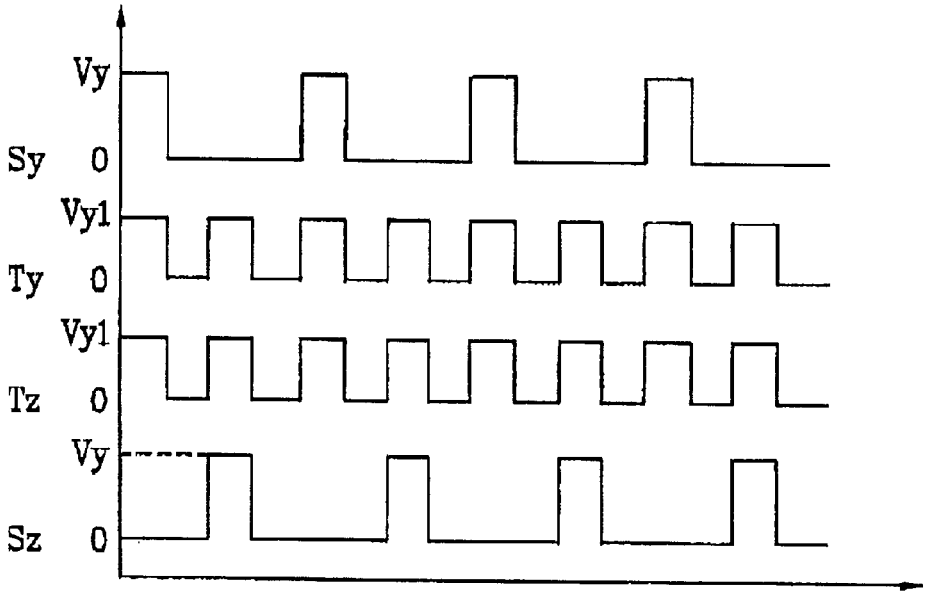
FIG. 8 illustrates a driving waveform applied to the PDP shown in FIG. 6 during a sustain period.

Meanwhile, in the present invention, a driving waveform of FIG. 8 may be generated.

Referring to FIG. 8, the sustain pulses having the same voltage value Vy (ex, 350V) are alternately supplied to the scan/sustain electrode Sy and the common sustain electrode Sz, and the sustain pulses having the same voltage value Vyl (ex, 200V) axe supplied to the first and second trigger electrodes Ty and Tz to synchronize with the sustain pulses applied to the scan/sustain electrode Sy and the common sustain electrode Sz. It is assumed that the sustain pulse having a voltage value of 350V is supplied to the scan/sustain electrode Sy and the sustain pulse having a voltage value of 0V is supplied to the common sustain electrode Sz. In this case, if the sustain pulse having a voltage of 350V is supplied to the scan/sustain electrode Sy, a voltage difference of 100V occurs between the scan/sustain electrode Sy and the first trigger electrode Ty. If the sustain pulse having a voltage of 0V is supplied to the common sustain electrode Sz, a voltage difference of 200V occurs between the common sustain electrode Sz and the second trigger electrode Tz. At this time, the wall charges formed in the discharge cells selected in the address period are added to the voltage of 200V supplied to the second trigger electrode Tz, so that the trigger discharge occurs between the common sustain electrode Sz and the second trigger electrode Tz as shown in FIG. 9. After the trigger discharge occurs between the common sustain electrode Sz and the second trigger electrode Tz, the sustain discharge occurs between the scan/sustain electrode Sy and the common sustain electrode Sz. Afterwards, the sustain pulse having a voltage value of 350V is supplied to the common sustain electrode Sz and the sustain pulse having a voltage value of 0V is supplied to the scan/sustain electrode Sy. Once the sustain pulse having a voltage value of 0V is supplied to the scan/sustain electrode Sy, the trigger discharge occurs between the scan/sustain electrode Sy and the first trigger electrode Ty as shown in FIG. 10. After the trigger discharge occurs between the scan/sustain electrode Sy and the first trigger electrode Ty, the sustain discharge occurs between the scan/sustain electrode Sy and the common sustain electrode Sz. Actually, the sustain pulse is supplied to the respective electrodes Sy, Sz, Ty, and Tz, so that the sustain discharge occurs. Meanwhile, in the driving waveform according to another embodiment of the present invention as shown in FIG. 8, the sustain pulses always having the same voltage are supplied to the trigger electrodes Ty and Tz. The trigger electrodes Ty and Tz of the PDP in which the driving waveform of FIG. 8 is generated may be added electrically and/or physically to each other.

Figure 11:
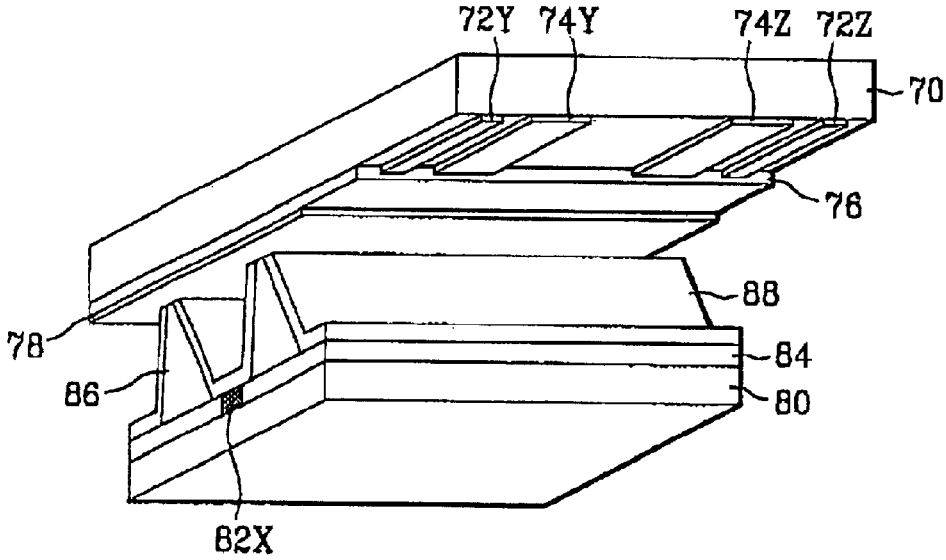
FIG. 11 is a perspective view illustrating a discharge cell of a PDP according to the second embodiment of the present invention.

FIG. 11 is a perspective view illustrating a discharge cell of a PDP according to the second embodiment of the present invention.

Referring to FIG. 11, the PDP according to the second embodiment of the present invention includes first and second trigger electrodes 72Y and 72Z formed at a peripheral portion of a discharge cell on an upper substrate 70, scan/sustain electrode 74Y and a common sustain electrode 74Z formed to be adjacent to the first and second trigger electrodes 72Y and 72Z between the first and second trigger electrodes 72Y and 72Z, and an address electrode 82X formed at the center of a lower substrate 80 to be orthogonal to the first and second trigger electrodes 72Y and 72Z. On the upper substrate 70 on which the scan/sustain electrode 74Y, the first trigger electrode 72Y, the second trigger electrode 72Z, and the common sustain electrode 74Z are formed in parallel, an upper dielectric layer 76 and a passivation film 78 are layered. On the lower substrate 80 on which the address electrode 82X is formed, a lower dielectric layer 84 and a sidewall 86 are formed. A phosphor layer 88 is deposited on surfaces of the lower dielectric layer 84 and the sidewall 86.

Unlike the first embodiment of the present invention, in the second embodiment of the present invention, the scan/sustain electrode 74 and the common sustain electrode 74Z are formed between the first and second trigger electrodes 72Y and 72Z. Other structure and operation according to the second embodiment of the present invention will be equal to the first embodiment of the present invention. That is, in the PDP according to the second embodiment of the present invention, the driving waveform of FIG. 7 or FIG. 8 may be generated during the sustain period. Meanwhile, in the PDP according to the second embodiment of the present invention, if the driving waveform of FIG. 8 is formed, the trigger electrodes 72Y and 72Z formed in one discharge cell may be added to each other electrically and/or physically. Also, the trigger electrodes 72Y and 72Z formed in one discharge cell may electrically and/or physically be added to the trigger electrodes 72Y and 72Z formed in adjacent discharge cells.

As described above, the PDP and the driving method thereof according to the present invention have the following advantages.

The trigger electrodes are formed to be adjacent to the scan/sustain electrode and the common sustain electrode. Once the trigger electrodes are formed to be the scan/sustain electrode and the common sustain electrode, the sustain discharge can be generated by the trigger discharge only during the sustain period. That is, since the sustain discharge can be generated by the trigger discharge which is a fine discharge, a strong sustain discharge contributed to luminance can be generated. Therefore, luminance and luminous efficiency of the PDP can be improved.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. A plasma display panel (PDP), comprising:

a scan/sustain electrode formed side by side on an upper substrate so as to be positioned respectively toward both ends of a discharge cell;

a common sustain electrode;

a first trigger electrode formed side by side to be outwardly adjacent to the scan/sustain electrode; and a second trigger electrode formed side by side to be outwardly adjacent to the common sustain electrode, wherein the scan/sustain electrode and the common sustain electrode are formed between the first and second trigger electrodes, and a gap between the first trigger electrode and the scan/sustain electrode and a gap between the second trigger electrode and the common sustain electrode are smaller than a gap between the common sustain electrode and the scan/sustain electrode, and wherein a sustain discharge is generated between the scan/sustain electrode and the common sustain electrode, and a trigger discharge is generated between the first trigger electrode and the scan/sustain electrode and between the second trigger electrode and the common sustain electrode, respectively.

2. A method for driving a PDP including a scan/sustain electrode and a common sustain electrode on an upper substrate, and first and second trigger electrodes formed to be adjacent to the scan/sustain electrode and the common sustain electrode in parallel, driven by a sustain period, the method comprising:

alternately applying a first sustain pulse having a predetermined voltage to the scan/sustain electrode and the common sustain electrode during the sustain period;

supplying a second sustain pulse to the first trigger electrode whenever the first sustain pulse is supplied to the scan/sustain electrode and the common sustain electrode;

supplying a third sustain pulse to the second trigger electrode whenever the first sustain pulse is supplied to the scan/sustain electrode and the common sustain electrode, wherein the second and third sustain pulses have a lower voltage value than the first sustain pulse;

supplying the second sustain pulse having a lower voltage value than the first sustain pulse to the first trigger electrode when the first sustain pulse is supplied to the scan/sustain electrode; and supplying the third sustain pulse having a lower voltage value than the second sustain pulse to the second trigger electrode when the first sustain pulse is supplied to the scan/sustain electrode.

3. The method of claim 2, further comprising:

supplying the third sustain pulse having a lower voltage value than the first sustain pulse to the second trigger electrode when the first sustain pulse is supplied to the common sustain electrode; and supplying the second sustain pulse having a lower voltage value than the third sustain pulse to the first trigger electrode when the first sustain pulse is supplied to the common sustain electrode.

4. The method of claim 2, wherein the second and third sustain pulses have the same voltage value.

5. The method of claim 2, wherein the second sustain pulse having a lower voltage value than the first sustain pulse is synchronized with the first sustain pulse supplied to the scan/sustain electrode and the common sustain electrode, and is supplied to the first trigger electrode.

6. The method of claim 2, wherein the third sustain pulse having a lower voltage value than the first sustain pulse is synchronized with the first sustain pulse supplied to the scan/sustain electrode and the common sustain electrode, and is supplied to the second trigger electrode.

7. The method of claim 2, wherein a reset pulse is supplied to the second trigger electrode of the discharge cell during a reset period.

8. The method of claim 2, wherein scan pulses are sequentially supplied to the first trigger electrode during an address period, and data pulses synchronized with the scan pulses are supplied to an address electrode formed in a lower substrate opposing the upper substrate.

* * * * *